US010199788B1

(12) United States Patent
Argibay et al.

(10) Patent No.: US 10,199,788 B1
(45) Date of Patent: Feb. 5, 2019

(54) MONOLITHIC MAX PHASE TERNARY ALLOYS FOR SLIDING ELECTRICAL CONTACTS

(71) Applicant: National Technology & Engineering Solutions of Sandia, LLC, Albuquerque, NM (US)

(72) Inventors: Nicolas Argibay, Albuquerque, NM (US); Thomas Scharf, McKinney, TX (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 134 days.

(21) Appl. No.: 15/153,453

(22) Filed: May 12, 2016

Related U.S. Application Data

(60) Provisional application No. 62/167,847, filed on May 28, 2015.

(51) Int. Cl.

| | |
|---|---|
| ***H01R 39/02*** | (2006.01) |
| ***H01R 39/08*** | (2006.01) |
| ***H01R 39/04*** | (2006.01) |
| ***H01R 39/20*** | (2006.01) |

(52) U.S. Cl.
CPC ..... *H01R 39/025* (2013.01); *H01R 39/04* (2013.01); *H01R 39/08* (2013.01); *H01R 39/20* (2013.01)

(58) Field of Classification Search
USPC ..... 428/457, 469, 472, 697, 698, 699; 218/146; 200/262
See application file for complete search history.

(56) References Cited

U.S. PATENT DOCUMENTS

| | | | | |
|---|---|---|---|---|
| 6,544,674 | B2 * | 4/2003 | Tuller | H01L 21/048 428/469 |
| 7,402,206 | B2 | 7/2008 | Isberg et al. | |
| 7,553,564 | B2 * | 6/2009 | Gupta | C04B 35/56 428/698 |
| 7,786,393 | B2 | 8/2010 | Isberg et al. | |
| 8,487,201 | B2 | 7/2013 | Jansson et al. | |
| 2009/0047510 | A1 * | 2/2009 | Schuisky | C23C 14/0688 428/457 |
| 2010/0044345 | A1 * | 2/2010 | Oberg | H01H 1/021 218/146 |
| 2011/0000770 | A1 | 1/2011 | Jansson et al. | |
| 2011/0033784 | A1 | 2/2011 | Ljungcrantz et al. | |
| 2012/0132927 | A1 | 5/2012 | Seki et al. | |

(Continued)

OTHER PUBLICATIONS

Oberg et al "Conductive nanocomposite ceramics as tribological and electrical contact materials" Eur. Phys. Appl. Phys. 49 (2010) 22902-p1-22902-p6.*

(Continued)

*Primary Examiner* — Archene A Turner
(74) *Attorney, Agent, or Firm* — Helen S. Baca

(57) ABSTRACT

The present invention relates to monolithic structures for use as an electrical contact. In particular, these structures are formed from a laminate alloy, which in turn is composed of a $M_{n+1}AX_n$ compound. Electrical contact assemblies and electrical components having such contacts are also described herein. In some example, such monolithic structures display increased wear resistance, which is useful for sliding electrical contacts.

20 Claims, 14 Drawing Sheets

(56) References Cited

U.S. PATENT DOCUMENTS

2013/0210243 A1 8/2013 Argibay et al.
2014/0319432 A1 10/2014 Goeke et al.

OTHER PUBLICATIONS

Hu et al "Pulsed laser depostionand properties of M(n=1)AX(n) phase formulated Ti3SiC2 thin films" Triology Letters vol. 12 Nos. 1-2, (2004) p. 113-122.*
Gao et al "On physical and thermochemical properties of high-purity Ti3SiC2" Material Letters 55 (2002) p. 61-66.*
Eklund et al "Synthesis and characterization of Ti—Si—C compounds for electrical contact applications" Proceedings of the 51st Holm Conference on Electrical Contacts (2005) p. 277-283.*
Gupta et al "On the tribology of the MAX phases and their composites during dry sliding:A review" Wear 271 (2011) p. 1878-1894.*
Gupta et al "Ambient and 550 degrees C tribological behavior of select MAX phases against Ni-based superalloys" Wear 264 (2008 ) p. 270-278.*
Souchet et al The role of Tribofilm Evolution on Tribological Behaviour of Ti3SiC2 ceraminc World Tribology Congress III (2005) p. 1-2.*
Zhai et al "Oxidation layer in sliding friction surface of high-purity Ti3SiC2" Journ Mat Sci. (2004) 39 p. 6635-6637.*
Huang et al "Tribological behaviors and mechanisms of Ti3AlC2" Tribology Letters vol. 27, No. 2 (2007) p. 129-135.*
Wu et al "Reciprocating friction and wear of Ti3AlC2 and Ti3AlC2/Al2O3 composites against AlS52100 bearing steel" Wear 266 (2009) p. 158-166.*
Argibay, N. et al., "Wear resistant electrically conductive Au—ZnO nanocomposite coatings synthesized by e-beam evaporation," *Wear* 2013;302:955-62.
Barsoum, M.W. et al., "Elastic and mechanical properties of the MAX phases," *Annu. Rev. Mater. Res.* 2011;41:195-227.
Björk, V. et al., "Final Report on Carbon Strip Challenge: designing new carbon strips for better railing," KET050 Carbon Strip Challenge, Lund University, Department of Chemical Engineering, Faculty of Engineering, Brussels, Belgium, Jun. 17, 2010 (51 pp.).
Eklund, P. et al., "Microstructure and electrical properties of Ti—Si—C—Ag nanocomposite thin films", *Surf. Coat. Technol.* 2007;201:6465-9.
Eklund, P, "Novel ceramic Ti—Si—C nanocomposite coatings for electrical contact applications," *Surf Eng.* 2007;23(6):406-11.
Eklund, P. et al., "The $M_{n-1}AX_n$ phases: materials science and thin-film processing," *Thin Solid Films* 2010;518:1851-78.
Emmerlich, J. et al., "Micro and macroscale tribological behavior of epitaxial $Ti_3SiC_2$ thin films," *Wear* 2008;264:914-9.
Gupta, S. et al., "On the tribology of the MAX phases and their composites during dry sliding: a review," *Wear* 2011;271:1878-94.
Hu, L. et al., "Fabrication and characterization of NiTi/$Ti_3SiC_2$ and NiTi/$Ti_2AlC$ composites," *J. Alloys Compounds* 2014;610:635-44.
Radovic, M. et al., "MAX phases: bridging the gap between metals and ceramics," *Am. Ceram. Soc. Bull.* 2013;92(3):20-7.
Scharf, T.W. et al., "Spark plasma sintered MAX phase ternary alloys for sliding electrical contacts," 70$^{th}$ *Society of Tribologists and Lubrication Engineers Annual Meeting*, held on May 17-21, 2015 in Dallas, Texas (abstract, 1 p.).
Scharf, T.W. et al., "Spark plasma sintered MAX phase ternary alloys for sliding electrical contacts," 70$^{th}$ *Society of Tribologists and Lubrication Engineers Annual Meeting*, held on May 17-21, 2015 in Dallas, Texas (presentation, 23 pp.).
Souchet, A. et al., "Tribological duality of $Ti_3SiC_2$," *Trib. Lett.* 2005;18(3):341-52.
Zhang, J. et al., "Fabrication of high purity $Ti_3SiC_2$ from Ti/Si/C with the aids of Al by spark plasma sintering," *J. Alloys Compounds* 2007;437:203-7.
Zhang, Y. et al., "$Ti_3SiC_2$—a self-lubricating ceramic," *Mater. Lett.* 2002;55:285-9.
Zhou, W.B. et al., "Rapid synthesis of $Ti_2AlC$ by spark plasma sintering technique," *Mater. Lett.* 2005;59:131-4.

* cited by examiner

MONOLITHIC MAX PHASE TERNARY ALLOYS FOR SLIDING ELECTRICAL CONTACTS

CROSS-REFERENCE TO RELATED APPLICATION

This application claims the benefit of U.S. Provisional Application No. 62/167,847, filed May 28, 2015, which is hereby incorporated by reference in its entirety.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to monolithic structures for use as an electrical contact. In particular, these structures are formed from a laminate alloy, which in turn is composed of a $M_{n+1}AX_n$ compound. Assemblies and components having such contacts are also described herein.

BACKGROUND OF THE INVENTION

Sliding electrical contact assemblies require at least one electrical contact that moves or slides against another conductive electrical contact. This movement can result in wear over time, as well as in generation of debris that can disrupt effective electrical connection between contact elements. Thus, sliding electrical contact materials rely on low friction, low wear, and low debris generation, while maintaining low sliding electrical contact resistance (ECR). Few materials possess all these qualities. For instance, electroplated gold alloys can exhibit relatively low friction and wear but display high ECR after continued use. Such gold alloys can be cost prohibitive. There is a need for additional materials possessing such beneficial qualities to form electrical contacts having stable characteristics without foregoing high performance use.

SUMMARY OF THE INVENTION

The present invention relates to a monolithic structure composed of MAX phase alloys (e.g., any described herein) for use as an electrical contact, as well as assemblies and components including such electrical contacts. Methods for making and employing such electrical contacts are also described herein.

Definitions

As used herein, the term "about" means+/−10% of any recited value. As used herein, this term modifies any recited value, range of values, or endpoints of one or more ranges.

As used herein, the term "monolith" and "monolithic" refers to a structure that is a shaped, fabricated, and/or intractable article with a homogeneous composition or a defined internal composition. Such compositions can include microscale or nanoscale structural features (e.g., internal and/or external features). In some instances, the monolith does not exhibit any structural components distinguishable by optical microscopy. In other instances, the monolith includes a defined internal composition of a laminate, where the internal composition includes interleaving layers and each layer has a distinct composition. In yet other instances, the laminate is a nanolaminate, in which each layer has a distinct composition and each layer is characterized by thickness or by a delamination structure (e.g., a break structure parallel to or orthogonal to a basal plane of the laminate structure) on a nanoscale. In some instances, the laminate is a microlaminate, in which each layer has a distinct composition and each layer is characterized by thickness or by a delamination structure (e.g., a break structure parallel to or orthogonal to a basal plane of the laminate structure) on a microscale. The monolith can be formed in any useful manner (e.g., any manner herein), such as by cold pressing or hot pressing of a material, or by using a reactive processing technique such as reaction injection molding, crosslinking, sol-gel processing, sintering, etc.

As used herein, the term "laminate" refers to a material including one or more layers, in which the layers are distinct in composition, composition profile, and/or anisotropy of properties. In some instances, the laminate can include a first layer of a first composition and a second layer of a second composition, and the first and second layers are interleaved in any useful pattern.

By the prefix "micro" is meant having at least one dimension that is less than 1 mm. For instance, a microstructure (e.g., any structure described herein, such as a laminate) can have an external feature (e.g., length, width, height, cross-sectional dimension, circumference, radius (e.g., external or internal radius), or diameter) and/or internal feature (e.g., grain size, laminate thickness, crystal size, etc.) that is less than 1 mm.

By the prefix "nano" is meant having at least one dimension that is less than 1 μm. For instance, a nanostructure (e.g., any structure described herein, such as a laminate) can have an external feature (e.g., length, width, height, cross-sectional dimension, circumference, radius (e.g., external or internal radius), or diameter) and/or internal feature (e.g., grain size, laminate thickness, crystal size, etc.) that is less than 1 μm.

As used herein, the terms "top," "bottom," "upper," "lower," "above," and "below" are used to provide a relative relationship between structures. The use of these terms does not indicate or require that a particular structure must be located at a particular location in the apparatus.

Other features and advantages of the invention will be apparent from the following description and the claims.

DETAILED DESCRIPTION OF THE INVENTION

Figure 1:
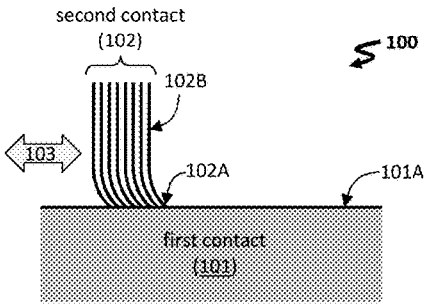
FIG. 1 provides a schematic of an exemplary electrical contact assembly 100 including a first contact 101 and a second contact 102 that is a monolithic structure including a laminate alloy.

This present invention relates to the use of monolithic MAX phase alloys as novel sliding electrical contact materials owing to their low friction, low wear, and/or low electrical contact resistance (ECR) when sliding against each other and against metallic alloys. We propose to protect the use of these alloys as bulk electrical contact materials to replace traditional graphite and metal-graphite monolithic electrical contact materials used in brushed or commutated DC electric motors and generators. Such alloys, in particular, are beneficial when provided in a monolithic form. Nonetheless, such monolithic forms can be used in combination with contacts having a film of these MAX phase materials, such as sprayed coatings, for use as conductive and wear resistant coatings for high current density metallic electrical contacts, e.g., such as those used in electrical signal and low power transmission slip rings.

In particular embodiments, one or more electrical contacts are composed of spark plasma sintered MAX phase alloys (e.g., $Ti_2AlC$, $Ti_3SiC_2$, and other described herein) were determined to perform exceptionally well as low wear, low friction materials with metal-like electrical conductivities (e.g., of from about 17 to 27 μΩ·cm). Friction coefficients as low as 0.15 (e.g., including of from about 0.2 to 0.5) and ECR values similar to noble metal electrical contacts (e.g., of from about 10 to 100 mΩ) were measured in sliding against each other against Cu and Au alloys.

The electrical contact described herein can be employed in any useful manner. In particular, the MAX phase alloys of the invention are a suitable replacement with potentially greatly superior tribological and electrical performance (longer service life and lower electrical losses) to graphite and metal-graphite brushes that are currently an industry standard in a wide range of electrical contact applications. Much like graphite and metal-graphite brushes, MAX phase alloys may be sintered into brush form and made to slide against metal alloy slip rings and rails. The possibility of using MAX phase materials in vacuum and low humidity environments is also of great interest, where nitrides and carbides typically exhibit high wear due to enhanced adhesion, and where graphite exhibits untenably high friction and wear behavior due to the lack of moisture. In these systems, the use of expensive thin gold alloy coatings or lamellar solid lubricants (e.g., such as $MoS_2$) are the industry standard solution. The ability to use bulk, relatively inexpensive, easy to manufacture, highly wear resistant, and highly electrically and thermally conductive materials, such as MAX phase alloys, may also present an improvement over industry standard thin film solid lubricants. Additional details follow.

MAX Phase Alloys

MAX phase materials encompass more than 60 ternary or higher carbide and nitride alloys. In one instance, the MAX phase material includes elements M, A, and X following the general formula $M_{n+1}AX_n$, where M is a transition metal (e.g., an early transition metal), A is an A group element (e.g., an element selected from Groups 12-16 in the IUPAC periodic table of elements), X is either carbon or nitrogen, and n is of from about 1 to about 3 (e.g., an integer of 1, 2, or 3).

MAX phase alloys exhibit a unique combination of ceramic and metallic properties, such as chemical inertness and relatively low friction in nominally unlubricated sliding, resistance to wear, and electrical conductivity values similar to fine grained bulk pure metals, such as copper or gold. The wear resistance is linked to hardness, typically in the range of about 2 to 8 GPa, exceeding that of many nanocrystalline (Hall-Petch strengthened) bulk metals, but still relatively soft compared to many ceramics (with hardness values exceeding 20 GPa). These hardness values impart a high resistance to abrasive wear, but remain low enough to render them readily machineable when compared to ceramics. The unusual combination of properties shared by these materials is attributed to their layered structure (e.g., a laminate, such as a microlaminate or a nanolaminate), with layers of $M_{n+1}X_n$ interleaved with pure A-group element layers. These layers can have any useful characteristic dimension, such as a thickness (e.g., measured orthogonal to a basal plane that extends along the major dimension of the layer) on a microscale or a nanoscale.

Some of these alloys (e.g., $Ti_2AlC$ and $Ti_3SiC_2$) also exhibit high electrical and thermal conductivity. It is the combination of high conductivity, wear resistance, and low friction exhibited by some of these alloys that lend themselves as potentially superior performance materials to traditional electrical sliding contact materials such as graphite and metal-graphite (e.g., Cu-graphite) composite sintered monolithic brushes in applications, such as direct current (DC) motor commutation, signal transfer slip rings, and other topologies of brushed electrical motors and generators.

M, A, and X can be selected from any useful element. Exemplary M elements include transition metals (e.g., early transition metals), such as those selected from scandium (Sc), titanium (Ti), vanadium (V), chromium (Cr), zirconium (Zr), niobium (Nb), molybdenum (Mo), hafnium (Hf), and/or tantalum (Ta). Exemplary A elements include aluminum (Al), silicon (Si), phosphorus (P), sulfur (S), gallium (Ga), germanium (Ge), arsenic (As), cadmium (Cd), indium (In), tin (Sn), thallium (Tl), and/or lead (Pb). Exemplary X elements include carbon (C), and/or nitrogen (N).

The stoichiometry of MAX phase alloys can be modified in any useful manner. Exemplary MAX phase alloys include $M_2AX$, e.g., such as $Ti_2AC$, $Ti_2AN$, $Ta_2AC$, $Ta_2AN$, $Cr_2AC$, or $Cr_2AN$; $M_3AX_2$, e.g., such as $Ti_3AC_2$, $Ti_3AN_2$, $Ta_3AC_2$, or $Ta_3AN_2$; or $M_4AX_3$, e.g., such as $Ti_4AN_3$, $Ti_4AC_3$, $Ta_4AN_3$, $Ta_4AC_3$, $Nb_4AC_3$, $Nb_4AN_3$, or $V_4AlC_{3-1/3}$. In some instances, A is optionally selected from the group of Al, Si, Ga, Ge, or Sn. In other instances, A is optionally selected from the group of Al, Si, S, Ga, Ge, In, Sn, Tl, or Pb.

In addition, $M_{n+1}AX_n$ compounds can be in ternary, quaternary, or higher phases. Ternary phases have three elements, e.g., $Ti_3SiC_2$; quaternary phases have four elements, e.g., $Ti_2AlN_{0.5}C_{0.5}$ or $(Nb,Ti)_2AlC$, and so on. The ternary, quaternary, or higher phases may share many of the attributes of the binary phases (e.g., thermal, elastic, chemical, and/or electrical attributes).

Exemplary non-limiting MAX phase alloys include $Ti_2AlC$, $Ti_2AlN$, $Ti_2AlN_{0.5}C_{0.5}$, $V_2AlC$, $Cr_2AlC$, $Hf_2PbC$, $Nb_2AlC$, $(Nb,Ti)_2AlC$, $Ti_2GeC$, $V_2GeC$, $Cr_2GeC$, $Zr_2SnC$, $Ta_2AlC$, $Ta_2GaC$, $Hf_2SnC$, $Hf_2SnN$, $Ti_2SnC$, $Nb_2SnC$, $Zr_2PbC$, $Ti_2PbC$, $V_2PC$, $Nb_2PC$, $V_2AsC$, $Nb_2AsC$, $Ti_2SC$, $Zr_2SC$, $Nb_2SC_{0.4}$, $Hf_2SC$, $Ti_2SC$, $Zr_2SC$, $Nb_2SC$, $Hf_2SC$, $Ti_2GaC$, $Ti_2GaN$, $V_2GaC$, $V_2GaN$, $Cr_2GaC$, $Cr_2GaN$, $Nb_2GaC$, $Mo_2GaC$, $Sc_2InC$, $Ti_2InC$, $Ti_2InN$, $Zr_2InC$, $Zr_2InN$, $Nb_2InC$, $Hf_2InC$, $Ti_2TlC$, $Zr_2TlC$, $Zr_2TlN$, $Hf_2TlC$, $Ti_3AlC_2$, $Ti_3GeC_2$, $Ti_3SiC_2$, $Ti_4AlN_3$, $Ti_4SiC_3$, $Ta_4AlC_3$, $Nb_4AlC_3$, or $V_4AlC_{3-1/3}$.

The MAX phase alloy can be produced in any useful manner. For a monolithic structure, the phase alloy can be produced, e.g., by one or more of pressing (e.g., hot isotactic pressing), sintering (e.g., spark plasma sintering, pulse discharge sintering, or pressure less sintering), synthesis (e.g., self-propagating high temperature synthesis, solid-liquid reaction synthesis, or solid phase reaction synthesis), or printing (e.g., three-dimensional printing). When provided as a film, the MAX phase alloy can be produced, e.g., by physical vapor deposition (PVD), chemical vapor deposition (CVD), electrochemical deposition, electroless deposition, spraying, or thermal plasma spraying.

Figure 6:
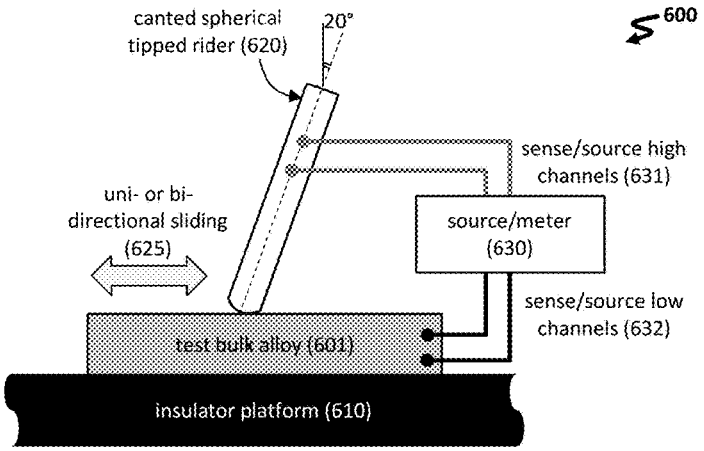
FIG. 6 provides a schematic of an exemplary experimental apparatus 600 for testing materials and electrical contacts of the present invention.
Figure 7A:
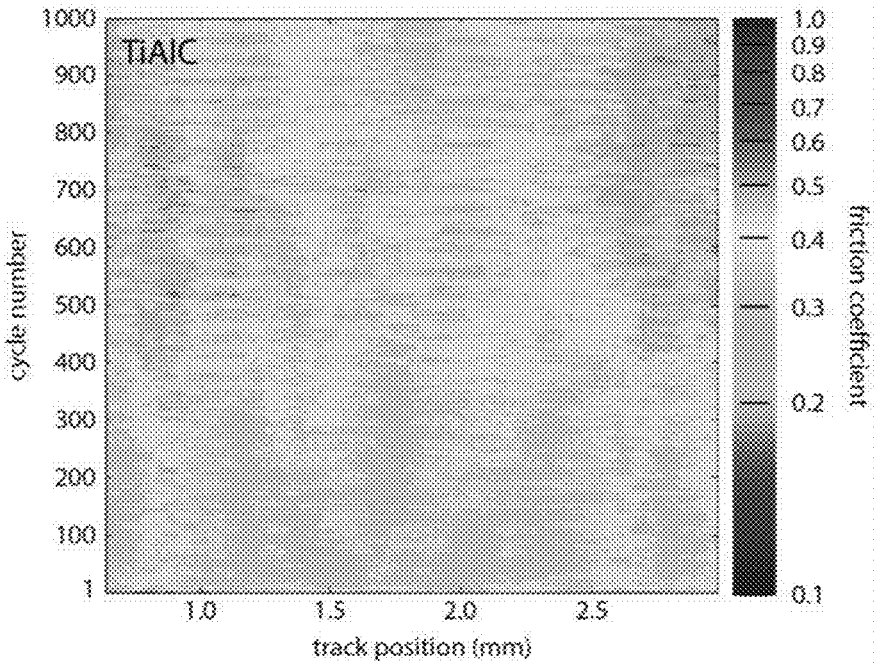
FIG. 7A-7B provides triboscopy maps showing the spatial evolution of (A) friction coefficient values and (B) corresponding electrical contact resistance values for $Ti_2AlC$ under 185 MPa contact stress with a hardened Au alloy rider traveling at a sliding speed at 1 mm/s. These values are provided spatially across track position (x-axis) as a function of cycle number (y-axis). As can be seen, $Ti_2AlC$ exhibited a low friction coefficient (about 0.5 or less) and low ECR (<about 0.1Ω) values for 1,000 cycles.
Figure 7B:
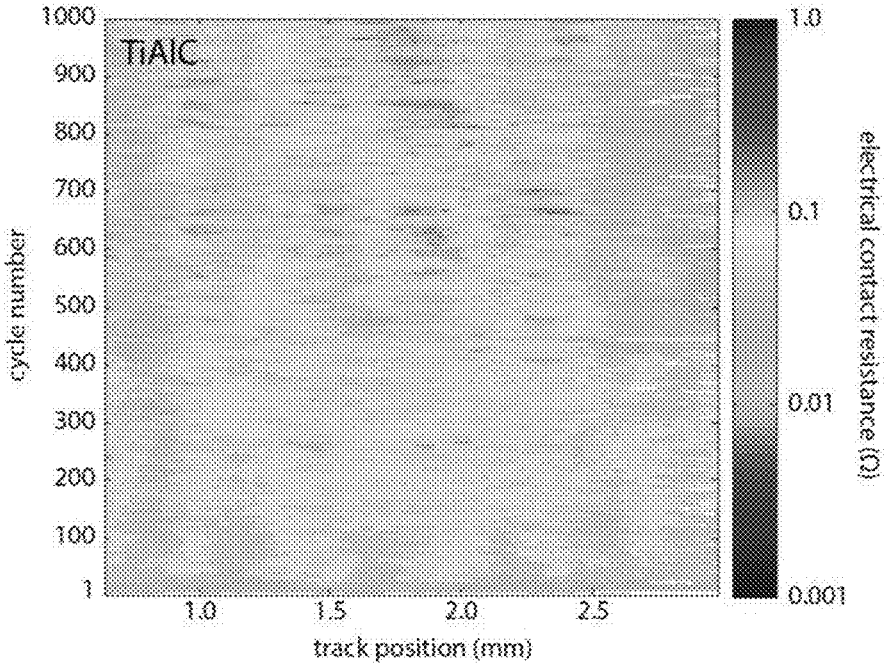
Figure 8A:
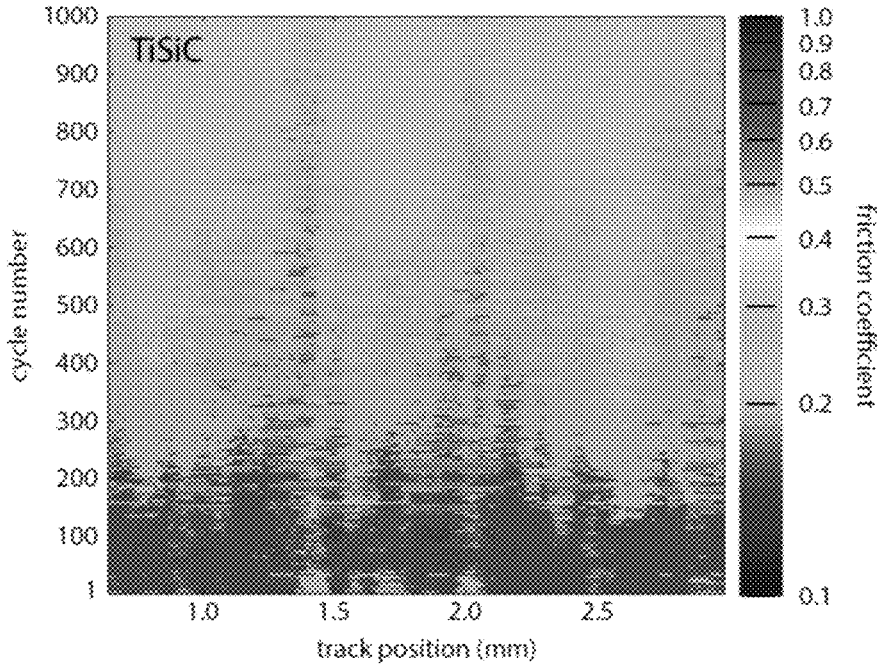
FIG. 8A-8B provides triboscopy maps showing the spatial evolution of (A) friction coefficient values and (B) corresponding electrical contact resistance values for $Ti_3SiC_2$ under 185 MPa contact stress with a hardened Au alloy rider traveling at a sliding speed at 1 mm/s. These values are provided spatially across track position (x-axis) as a function of cycle number (y-axis). As can be seen, $Ti_3SiC_2$ exhibited a low friction coefficient (about 0.3 or less) and low ECR (<about 0.5Ω) values for 1,000 cycles.
Figure 8B:
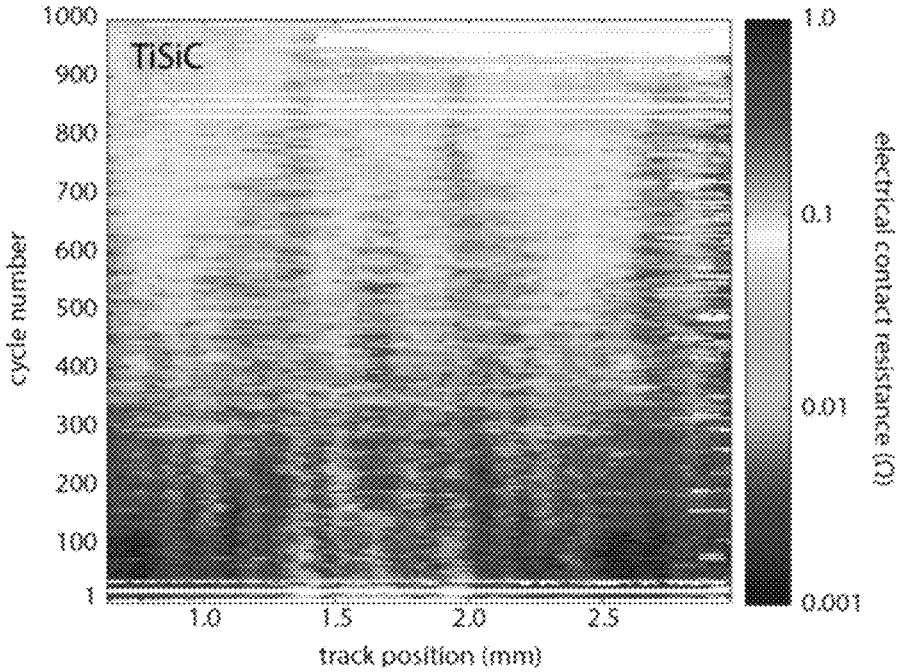

MAX phase alloys can be tested in any useful manner. Exemplary tests include tribological, mechanical, chemical, and/or electrical analyses. In one embodiment, the test includes sliding electrical contact resistance tests, in which data are acquired and stored for normal force, friction force, wear track position, electrical current flow through the circuit, and voltage drop across the contact. Any useful test apparatus can be employed, such as experimental apparatus 600 in FIG. 6, which includes a test substrate 601 (e.g., a test alloy) connected to a source/meter unit 630 and a canted rider 620 that applies a force in any useful direction 625 (e.g., a unidirectional or bidirectional sliding force). The test substrate 601 can be mounted on an insulator platform 610 and connected to the source/meter unit 630 with high and low channels 631,632 to provide electrical current through the contact in a voltage-regulated remote-sensing mode. The voltage can be uniform or varied for each test alloy to achieve approximate direct currents (DC) (e.g., DC of about 100 mA). Additional details are provided in Argibay N et al., "Wear resistant electrically conductive Au—ZnO nanocomposite coatings synthesized by e-beam evaporation," *Wear* 2013; 302:955-62, which is incorporated herein by reference in its entirety.

Additional metals and alloys, as well as methods for preparing and testing such alloys, are described in Barsoum M W et al., "Elastic and mechanical properties of the MAX phases," *Annu. Rev. Mater. Res.* 2011; 41:195-227; Radovic M et al., "MAX phases: bridging the gap between metals and ceramics," *Am. Ceram. Soc. Bull.* 2013; 92(3):20-7; Gupta S et al., "On the tribology of the MAX phases and their composites during dry sliding: a review," *Wear* 2011; 271: 1878-94; Hu L et al., "Fabrication and characterization of NiTi/$Ti_3SiC_2$ and NiTi/$Ti_2AlC$ composites," *J. Alloys* Compounds 2014; 610:635-44; Eklund P, "Novel ceramic Ti—Si—C nanocomposite coatings for electrical contact applications," *Surf Eng.* 2007; 23(6):406-11; Eklund P et al., "The $M_{n-1}AX_n$ phases: materials science and thin-film processing," *Thin Solid Films* 2010; 518:1851-78; Emmerlich J et al., "Micro and macroscale tribological behavior of epitaxial $Ti_3SiC_2$ thin films," *Wear* 2008; 264:914-9; Souchet A et al., "*Tribological duality of* $Ti_3SiC_2$," *Trib. Lett.* 2005; 18(3): 341-52; Zhang J et al., "Fabrication of high purity $Ti_3SiC_2$ from Ti/Si/C with the aids of Al by spark plasma sintering," *J. Alloys Compounds* 2007; 437:203-7; Zhang Y et al., "$Ti_3SiC_2$—a self-lubricating ceramic," *Mater. Lett.* 2002; 55:285-9; and Zhou W B et al., "Rapid synthesis of $Ti_2AlC$ by spark plasma sintering technique," *Mater. Lett.* 2005; 59:131-4, as well as U.S. Pat. Nos. 7,786,393 and 8,487,201 and U.S. Pat. Pub. Nos. 2011/0033784, 2012/0132927, and 2014/0319432, each of which is incorporated herein by reference in its entirety.

Electrical Contacts

The present invention relates to one or more MAX phase alloys that are provided as a monolithic structure for use as an electrical contact. In one instance, the electrical contact is employed in an electrical contact assembly configured to sliding one contact against a surface (i.e., a contact surface, or a portion thereof) of another contact.

FIG. 1 provides an exemplary electrical contact assembly 100 including a first contact 101 and a second contact 102. In general, as discussed herein, the first contact includes a conductive material; and the second contact is configured for conductive engagement with the first contact. In some embodiments, the second contact includes a monolithic structure of a laminate alloy (e.g., a MAX phase alloy, such as any described herein).

In the assembly 100 (FIG. 1), the first contact 101 includes a surface 101A, of which a portion of this surface (the contact surface) conductively engages with the second contact 102. The contact surface includes an interface 102A formed by the second contact engaging the first contact. Engagement can include unidirectional or bidirectional motion 103 of the second contact 102 against a surface (or a portion thereof) of the first contact 101. This motion can include linear, rotational, or other types of motion.

Figure 2:
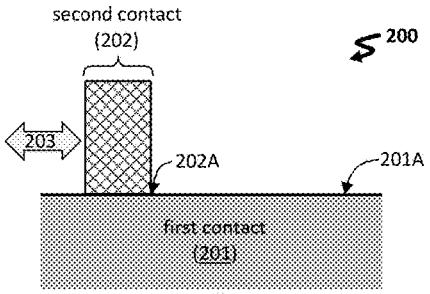
FIG. 2 provides a schematic of another exemplary electrical contact assembly 200 including a first contact 201 and a second contact 202 that is a monolithic structure including a laminate alloy.

The first and second contacts can have any useful configuration. For instance, the second contact can include a plurality of bristles 102B. In another instance, the second contact can include a bulk structure. FIG. 2 provides an exemplary electrical contact assembly 100 including a first contact 201 having a surface 201A and a second contact 202 that is a bulk structure having a surface 202A configured to conductively engage the first contact in any useful motion 203. In addition, any useful surface can be employed, in which the first and/or second contact can include a curved surface, a planar surface, a bristle surface, etc.

The first and second contacts can be formed from any useful conductive material (e.g., a metal, metal alloy, or laminate alloy, including a monolithic structure or a film disposed on a conductive substrate). Exemplary metals and alloys include copper, iron, aluminum, silver, nickel, molybdenum, tin, and other metals that can be added to those metals to form metal alloys (e.g., brass, bronze, and steel), as well as any MAX alloy described herein. In particular embodiments, the second contact is formed from a laminate alloy of a MAX compound (e.g., any described herein). In some embodiments, the first contact is formed from a metal or a metal alloy and optionally includes a film composed of a MAX compound (e.g., any described herein).

Components

The electrical contact(s) of the invention, as well as assemblies thereof, can be included in any useful electrical component (e.g., a motor, a generator, a railgun, a turbine, or a satellite). In one instance, the electrical contact(s), or an assembly thereof, is incorporated into any component for which traditional graphite and metal-graphite electrical brushes are employed (e.g., in brushed or commutated electric motors and generators). In another instance, the electrical contact(s), or an assembly thereof, is incorporated into a rail-armature interface. In yet another instance, the electrical contact(s), or an assembly thereof, is employed as a metal substrate or a metal fiber brush for high current density electrical contacts, such as those used in electrical signal and low power transmission slip rings (e.g., on wind turbines and satellites).

Figure 3:
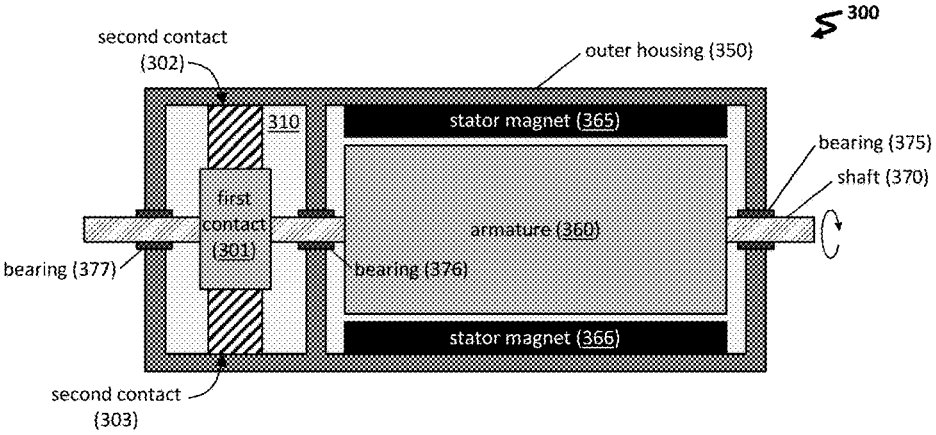
FIG. 3 provides a schematic of an exemplary electrical component 300 including a first contact 301 and a plurality of second contacts 302,303.

FIG. 3 provides an exemplary component 300 that is a motor (e.g., a brushed DC motor) and that includes a sliding contact assembly. The motor 300 includes an outer housing 350, an armature 360 that is mounted to a central shaft 370, and airtight bearings 375,376 that form seals around the shaft. Surrounding the armature 360 are stator magnets 365,366.

The motor 300 further includes a sealed compartment 310 that contains a first contact 301 (e.g., a commutator), which is also mounted to the shaft 370. The compartment 310 is sealed around the shaft 370 with airtight bearings 376,377. Also provided within the compartment 310 are second contacts 302,303 (e.g., brushes, which optionally include bristles) that make physical contact the outer surface of the first contact 301 while it rotates with the shaft.

Figure 4:
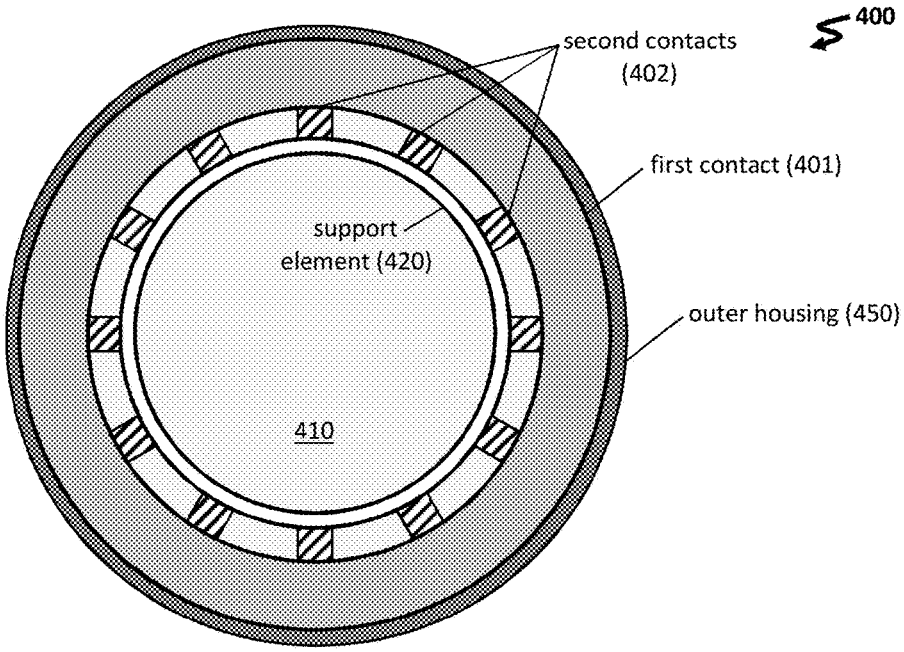
FIG. 4 provides a schematic of an exemplary electrical component 400 including a first contact 401 (e.g., a slip ring) and a plurality of second contacts 402.

FIG. 4 provides another exemplary component 400 that is a generator (e.g., for use in a wind turbine) and that includes a sliding contact assembly. The generator 400 includes an outer housing 450 that houses a first contact 401 (e.g., a slip ring). In this cross-sectional view, only one first contact is shown, but the component can include an array of a plurality of first contacts (e.g., a plurality of slip rings arranged within the bore and along the central axis of the outer housing) and an arrangement of second contacts associated with each first contact (e.g., an arrangement of second contacts disposed on a support element, where one arrangement is associated with each slip ring).

Positioned within the first contact 401 is a plurality of second contacts 402 that are supported in a useful configuration by a support element 420 to engage the first contact. The space 410 between the first contact(s) and second contacts is sealed.

Figure 5:
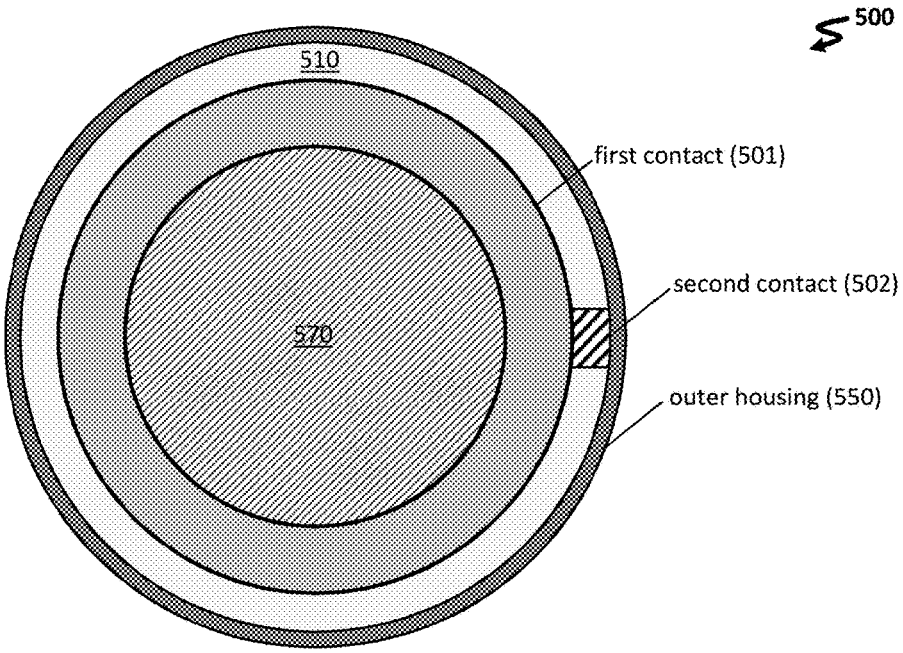
FIG. 5 provides a schematic of an exemplary electrical component 500 including a first contact 501 (e.g., a slip ring) and a second contact 502.

FIG. 5 provides yet another exemplary component 500 that includes a sliding contact assembly. The component 500 includes an outer housing 550 that houses a first contact 501 (e.g., a slip ring). In this cross-sectional view, only one first contact is shown, but the component can include an array of a plurality of first contacts (e.g., a plurality of slip rings arranged within the bore and along the central axis of the outer housing) and a plurality of second contacts, in which each second contact is associated with each first contact.

Positioned outside of the first contact 501 is a second contact 502 that is supported by the outer housing. The space 510 between the first contact(s) and second contact(s) is sealed. A shaft 570 can be disposed within the bore and along the central axis of the outer housing, and the first contact (e.g., a slip ring, as well as arrays thereof) can be disposed along the shaft. Additional components are described in U.S. Pat. Pub. No. 2013/0210243, which is incorporated herein by reference in its entirety.

EXAMPLES

Example 1: Monolithic MAX Phase Ternary Alloys for Sliding Electrical Contacts Gold is currently used in sliding electrical contact applications due to its high electrical conductivity and excellent corrosion and oxidation resistance. While electroplated hard gold (alloyed with Ni) has produced improvements over pure gold platings in sliding friction and wear performance, it has reliability issues regarding increased electrical contact resistance (ECR) over time and at elevated temperatures. In particular, increase in ECR may arise from the formation of surface metal oxide films and can cause system failure in low voltage and high frequency applications, especially systems that expect service lives on the order of years.

Avoiding low conductivity (i.e., high ECR) oxide films is paramount for next generation sliding electrical contact materials. As important are improved friction/wear resistance and cost reduction of hard Au. Spark plasma sintered MAX phase alloys (e.g., $Ti_2AlC$ and $Ti_3SiC_2$) are potential alternatives due to low resistivity (p of about 20 to 30 μΩ·cm compared to p of about 3 μΩ·cm for Au), high hardness, low friction, and low wear.

MAX phase materials encompass more than 60 ternary alloys, where M is an early transition metal, A is an A-group element (subset of groups 12 through 16), and X is either carbon or nitrogen, following the general formula $M_{n+1}AX_n$, where n=1, 2, or 3. MAX phase alloys exhibit a unique combination of ceramic and metallic properties, such as chemical inertness, relatively high hardness, and electrical conductivity (e.g., about 17 to 27 μΩ·cm) values similar to fine grained bulk pure metals such as copper or gold.

Furthermore, monolithic sliding electrical contact materials have advantages over films, including no need for extra processing step(s) and no issues with the film potentially wearing out and adhesion issues. Use of monolithic structures allow for use of such monolithic contacts in different application spaces, in which, e.g., complex shapes without the need for conformal coatings can be employed. Thus, in some embodiments of the invention, the contact material is provided as a monolithic structure and not as a film structure.

To this end, spark plasma sintered MAX phase ternary alloys were analyzed as novel sliding electrical contact materials owing to their low friction, low wear, and low electrical contact resistance (ECR) when sliding against certain metallic alloys and against each other. The friction, wear, and ECR behaviors of MAX phase $Ti_2AlC$, $Ti_3SiC_2$, and $Cr_2AlC$ were determined in a sliding ECR tribometer in both unidirectional and bidirectional modes. In particular, the $Ti_2AlC$ phase performed exceptionally well in a self-mated crossed-cylinder sliding contact and against Cu and Au alloys, with friction coefficients as low as μ=0.15 and low ECR values similar to noble-metal electrical contacts (e.g., of from about 10 to 100 me). Mechanistic studies using microscopy and spectroscopy techniques revealed that different tribochemical phases were responsible for the improvement in both tribological and electrical properties. Details for tribological, mechanical, and chemical tests are described in the following Examples.

Example 2: Tribological Tests of Sliding Electrical MAX/Au or MAX/$Al_2O_3$Contacts Sliding electrical contact experiments were performed to test MAX phase alloys (sintered $Ti_2AlC$ and $Ti_3SiC_2$) against a sliding hardened gold (Au) alloy rider or a sapphire ($Al_2O_3$) rider. An exemplary experimental apparatus is described in FIG. 6, as well as in Argibay N et al., "Wear resistant electrically conductive Au—ZnO nanocomposite coatings synthesized by e-beam evaporation," *Wear* 2013; 302:955-62, which is incorporated herein by reference in its entirety. For the present experiments, a spherical tipped rider (R=1.59 mm) was composed of either hardened Au alloy or $Al_2O_3$ (sapphire) and employed with either unidirectional or bidirectional sliding at a travel speed of 1 mm/sec. The hardened Au alloy was a wear resistant, chemically inert, high conductivity spherically tipped 17k gold based alloy pin (commercially available from Derringer-Ney, Vernon Hills, Ill. under the trade name Neyoro® G, which is a high gold content alloy containing platinum, silver, and copper). Friction, wear, and electrical contact resistance (ECR) measurements were conducted with sintered $Ti_2AlC$ and $Ti_3SiC_2$ specimens consisting of two geometries (either 50 mm diameter×12.5 mm thick cylinders, or 3.175 mm diameter× 25.4 mm long cylinders). The applied normal load was 1 N contact stress ($P_m$~0.56 GPa for the Au alloy and $P_m$~0.9 GPa for sapphire). Experiments were conducted in lab air at 20% relative humidity and 20° C. Bulk electrical resistivity of $Ti_2AlC$ and $Ti_3SiC_2$ were measured to be 17.1 μΩ·cm and 27.5 μΩ·cm, respectively.

Triboscopy maps (friction coefficient and corresponding ECR values spatially reported across sliding track position as a function of cycle number) are shown in FIG. 7A-7B and FIG. 8A-8B. Both $Ti_2AlC$ (FIG. 7A-7B) and $Ti_3SiC_2$ (FIG. 8A-8B) exhibited relatively low friction coefficient and low ECR values. As can be seen, in nominally unlubricated conditions (lab air, 20% relative humidity, and 20° C.), the $Ti_2AlC$ and $Ti_3SiC_2$ materials exhibited low steady-state friction coefficient (μ~0.2 to 0.4) over 1,000 cycles of linear unidirectional sliding at 1 mm/s, 1 N of force, on a 1.6 mm radius tip, with a 3 mm long stroke per cycle. The steady-state ECR was below 100 mΩ (of from about 100 to 500 mΩ) for a 100 mA current.

These obtained experimental values were equivalent to a self-mated hard gold contact in equivalent conditions (optimal tribological material pair given the chemical inertness and high electrical conductivity of Neyoro® G), and far superior to typical commercial grade graphite or metal (Cu)-graphite brushes in equivalent conditions

Example 3: Deformation and Wear Studies for MAX Contacts

Further mechanistic studies were conducted to characterize wear for MAX contacts. In an effort to establish a baseline wear measurement for the two $Ti_2AlC$ and $Ti_3SiC_2$ alloys investigated, we performed sliding experiments using sapphire and precision ball bearing grade silicon nitride ($Si_3N_4$) balls of the same tip radius as the Neyoro® G pins. Given the significantly higher hardness of these two ceramic pins (20+ GPa), wear was transferred primarily to the MAX phase specimens. An exposure time dependent transition from low (μ~0.2) to high (μ~0.8) friction behavior was found for both MAX phase materials.

With shorter strokes and the use of bidirectional sliding rather than unidirectional sliding (greatly reducing the time between sliding contact events at any point on the wear tracks), the materials more quickly transitioned to high friction. Without wishing to be limited by mechanism, it may be likely that the MAX phase alloys exhibited a chemical or compositional affinity for one of the two pin materials. The $Ti_3SiC_2$ specimen sliding against sapphire ($Al_2O_3$) did not transition to high friction behavior with long (10 sec) delays between sliding cycles. There is also the possibility of a directionality effect; since the unidirectional sliding tests increased the time between contact events from 1 sec to 10 sec, it is not clear whether the added time between passes is the critical factor to mitigate a transition to high friction.

Characterization of the worn films revealed negligible deformation in sliding against hard gold. It was evident in post-sliding characterization via non-contact profilometry (scanning white light interferometry) that the Neyoro® G hard gold pin wore preferentially, and that the damage on the MAX phase materials was negligible.

Desired wear and contact resistance can be obtained by controlling the composition of the first and second contacts. Nonetheless, higher friction coefficient and ECR values are observed in non-MAX contacts, such as in self-mated hardened Au alloy sliding contacts (friction coefficient μ>0.8, ECR>0.5Ω, and high wear) and Cu—Be riders sliding on Cu (ECR>8Ω).

Figure 9A:
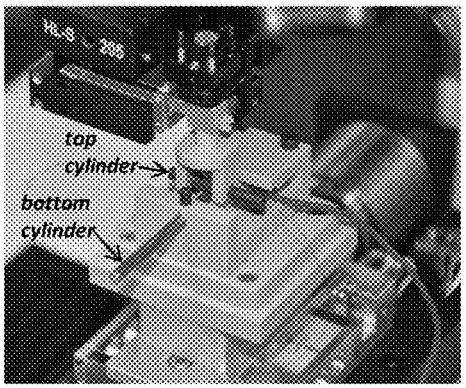
FIG. 9A-9C shows sliding ECR experiments for various assemblies including two cylinder contacts that are 90° crossed. Provided are (A) a photograph of the experimental apparatus for testing two contacts (top and bottom cylinder contacts) that are 90° crossed to form a crossed-cylinder contact; as well as (B) friction coefficient data and (C) ECR data for cross-cylinder contacts, including a $Ti_3SiC_2$ self-mated contact (in which both the top and bottom cylinder contacts were composed of $Ti_3SiC_2$), a $Ti_2AlC$ self-mated contact (in which both the top and bottom cylinder contacts were composed of $Ti_2AlC$), and a $Ti_3SiC_2/Ti_2AlC$ contact (in which one cylinder contact was composed of $Ti_3SiC_2$ and the cylinder contact was composed of $Ti_2AlC$).

Example 4: Crossed-Cylinder Tribological Tests for MAX/MAX Contacts or MAX/Cu Contacts In addition, crossed-cylinder tribological tests were conducted with self-mated $Ti_2AlC$ and $Ti_3SiC_2$ contacts, as well as these MAX phases against a hardened Cu alloy 101. For these experiments, cylinder contacts (R=1.59 mm) were composed of either a MAX alloy ($Ti_2AlC$ or $Ti_3SiC_2$) or a Cu alloy and employed with bidirectional sliding (1 mm stroke length; distance of 20 m) at a travel speed of 1 mm/sec. The applied normal load was 1 N ($P_m$~0.8 GPa for the MAX alloy and $P_m$~0.56 GPa for the Cu alloy/MAX phase). Experiments were measured for a constant current (10 mA). FIG. 9A is a photograph of a retrofitted nanotribometer configured for cross-cylinder contact experiments.

Figure 9B:
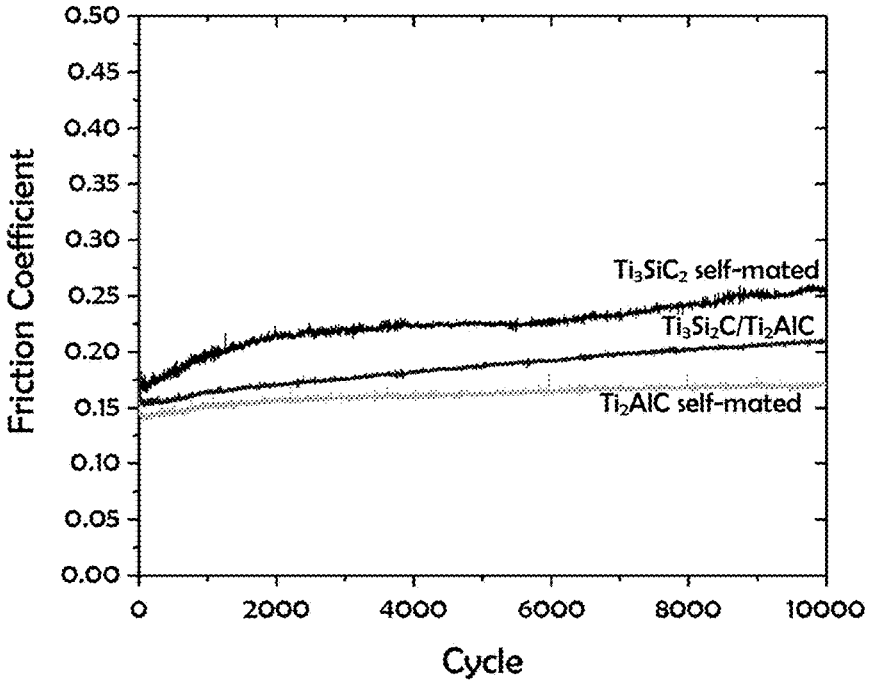
Figure 9C:
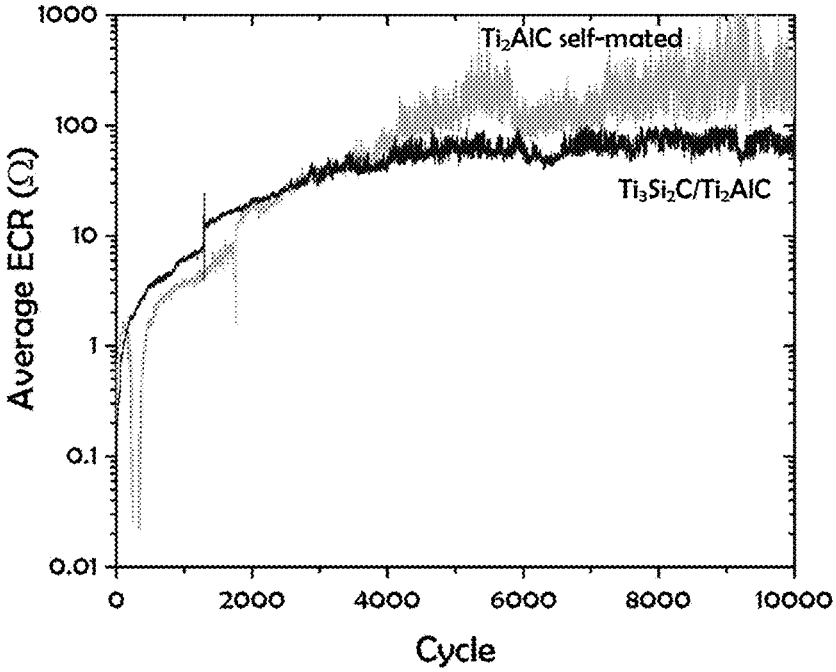
Figure 10A:
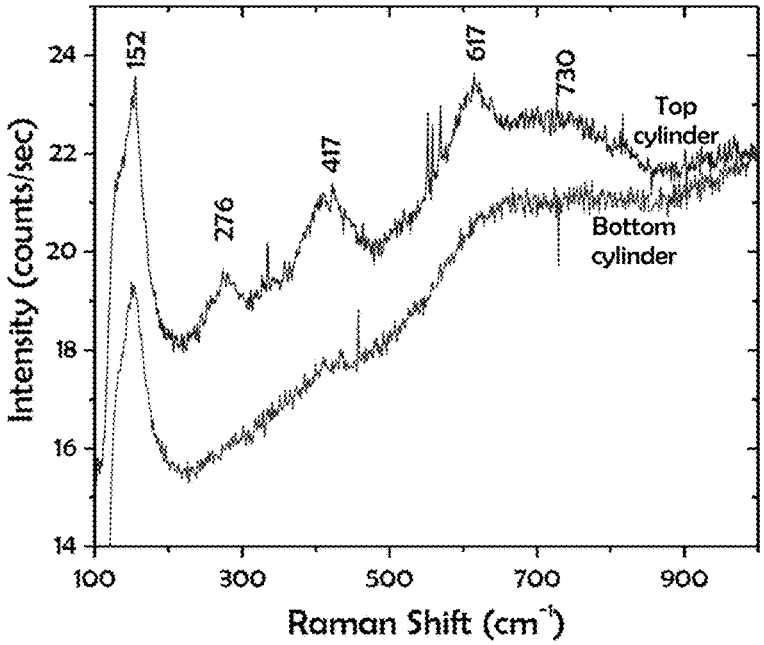
FIG. 10A-10B shows Raman analysis of different regions of a $Ti_3SiC_2$ self-mated cross-cylinder contact. Provided are (A) a Raman spectrum and (B) associated regions (denoted by black alignment square) for the top cylinder (left) and the bottom cylinder (right).
Figure 10B:
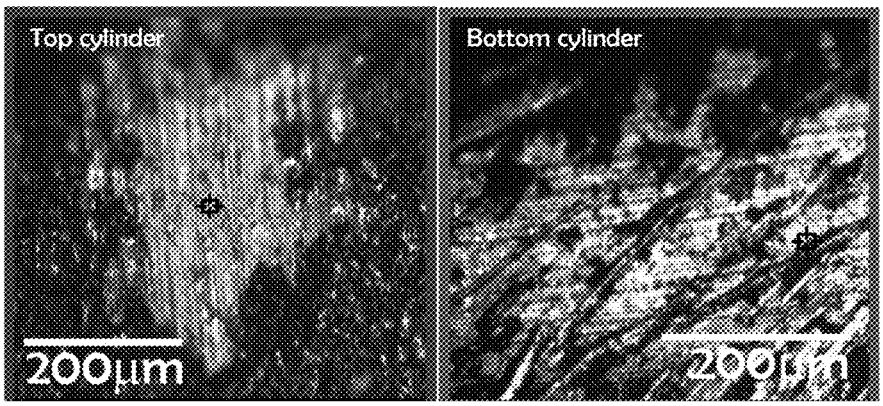
Figure 11A:
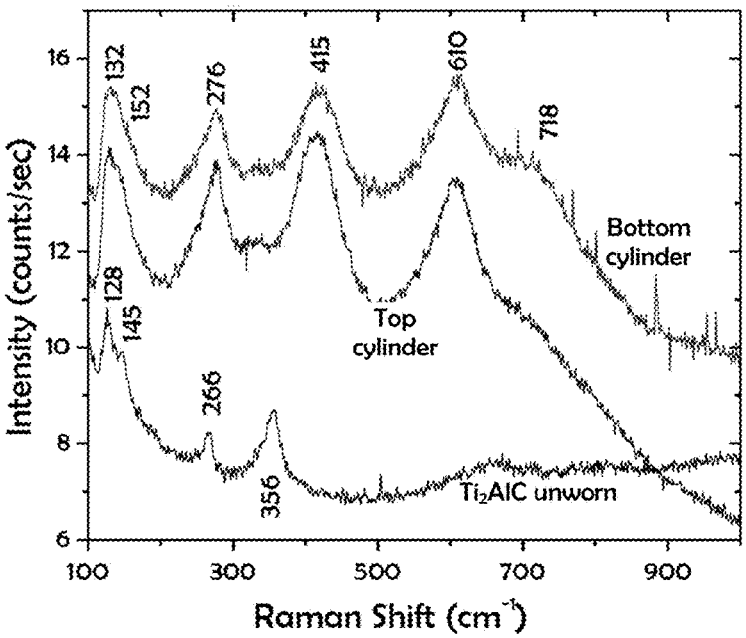
FIG. 11A-11B shows Raman analysis of different regions of a $Ti_2AlC$ self-mated cross-cylinder contact. Provided are (A) a Raman spectrum and (B) associated regions (denoted by black alignment square) for the top cylinder (left) and the bottom cylinder (right).
Figure 11B:
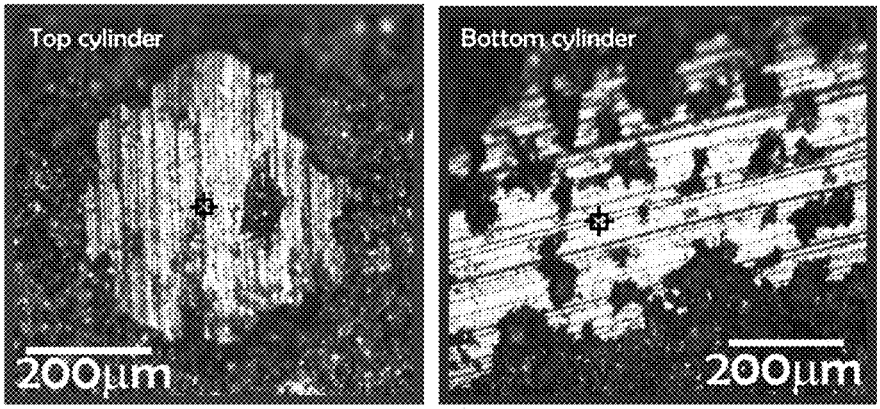

MAX/MAX cross-cylinder contacts were tested, including a self-mated $Ti_3SiC_2$ contact (top and bottom cylinder contacts both composed of $Ti_3SiC_2$), a self-mated $Ti_2AlC$ contact (top and bottom cylinder contacts both composed of $Ti_2AlC$), and a $Ti_3SiC_2/Ti_2AlC$ contact (one cylinder contact composed of $Ti_3SiC_2$ and another cylinder contact composed of $Ti_2AlC$). Low, stable friction coefficients were observed for MAX/MAX contacts (FIG. 9B). Initial ECR values were low, but followed by increasing ECR values that then reached steady-state after about 4,000 cycles (FIG. 9C).

Figure 12A:
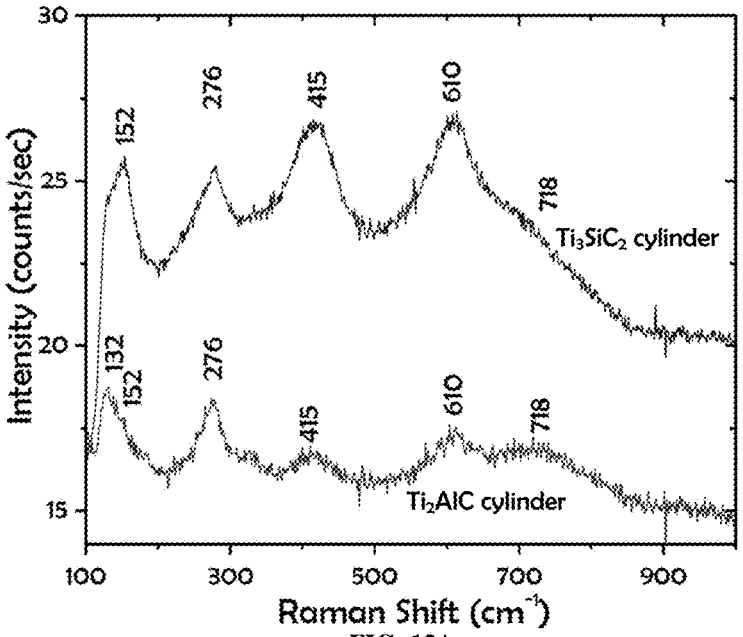
FIG. 12A-12B shows Raman analysis of different regions of a $Ti_3SiC_2/Ti_2AlC$ cross-cylinder contact. Provided are (A) a Raman spectrum and (B) associated regions (denoted by white alignment square) for the $Ti_3SiC_2$ cylinder (left) and the $Ti_2AlC$ cylinder (right).
Figure 12B:
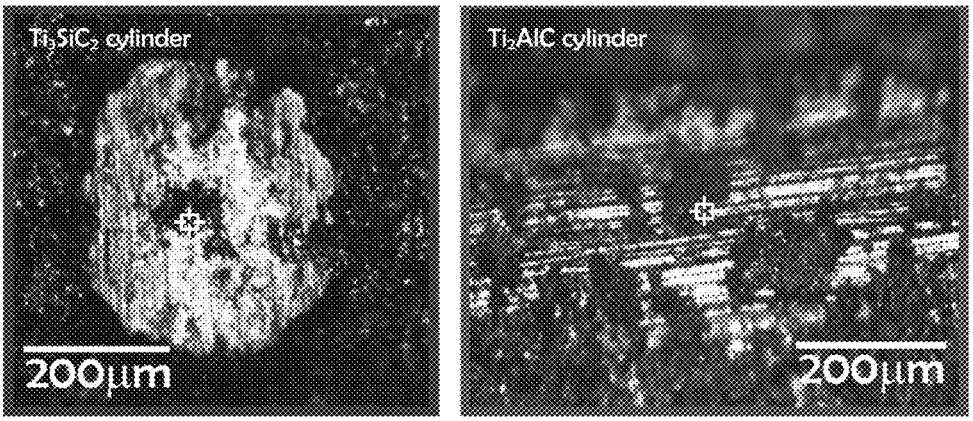

Raman analyses were conducted for the MAX/MAX contacts. The self-mated $Ti_3SiC_2$ contact and self-mated $Ti_2AlC$ contact had similar tribochemical phases, including $TiC_{1-x}$ peaks at about 276, 415, and 610 $cm^{-1}$, as well as more pronounced Ti—Si and Ti—Al planar shear vibrations at about 152 $cm^{-1}$ and about 130 $cm^{-1}$, respectively; and amorphous C peaks at about 1370 and 1573 $cm^{-1}$ (with $Ti_2AlC$ having great area fraction of phases) (FIG. 10A-10B and FIG. 11A-11B). These phases are in good agreement with $Al_2O_3$ sliding on $Ti_3SiC_2$ film. Raman analysis of the $Ti_3SiC_2/Ti_2AlC$ contact (FIG. 12A-12B) displayed similar phases as the self-mated contacts.

Figure 13A:
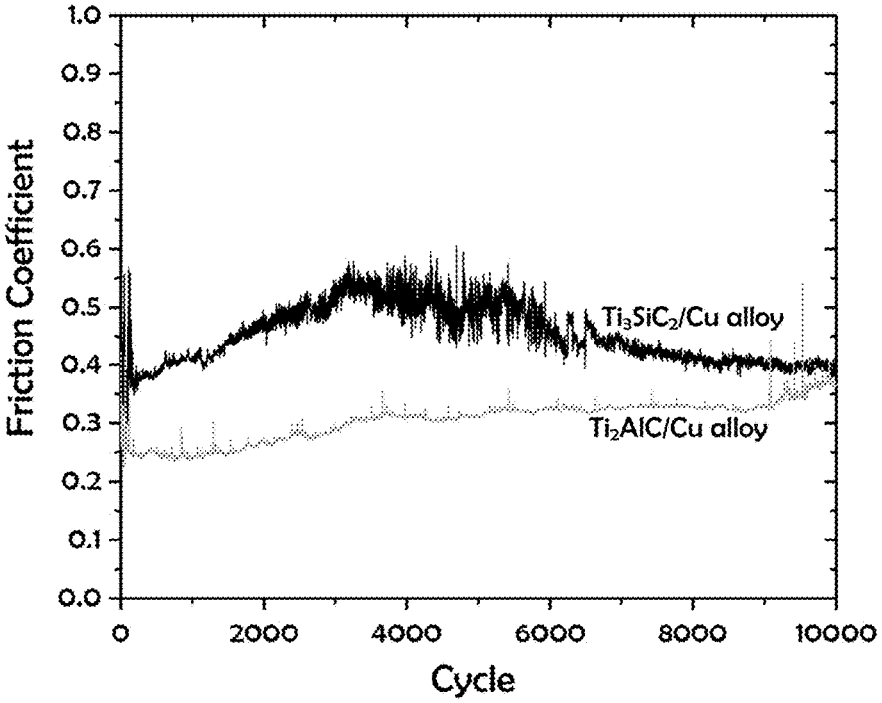
FIG. 13A-13B shows (A) friction coefficient data and (B) ECR data for a $Ti_3SiC_2$/Cu alloy cross-cylinder contact or a $Ti_2AlC$/Cu alloy cross-cylinder contact.
Figure 13B:
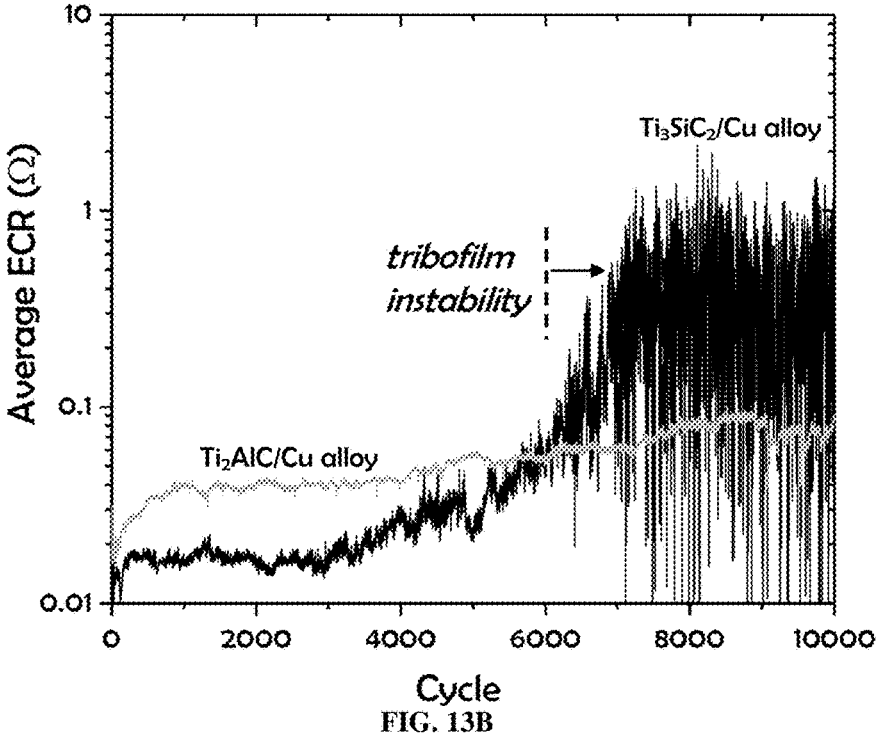

MAX/Cu cross-cylinder contacts were tested for MAX alloys of $Ti_3SiC_2$ and $Ti_2AlC$. Friction coefficients were slightly increased (FIG. 13A), as compared to self-mated contacts. However, ECR values decreased dramatically, i.e., about two orders of magnitude for $Ti_3SiC_2$ and three orders of magnitude for $Ti_2AlC$, which also importantly has very stable ECR values (FIG. 13B). In particular, the results from the $Ti_2AlC$/Cu sliding contact were excellent, as compared to hardened Au films.

Figure 14A:
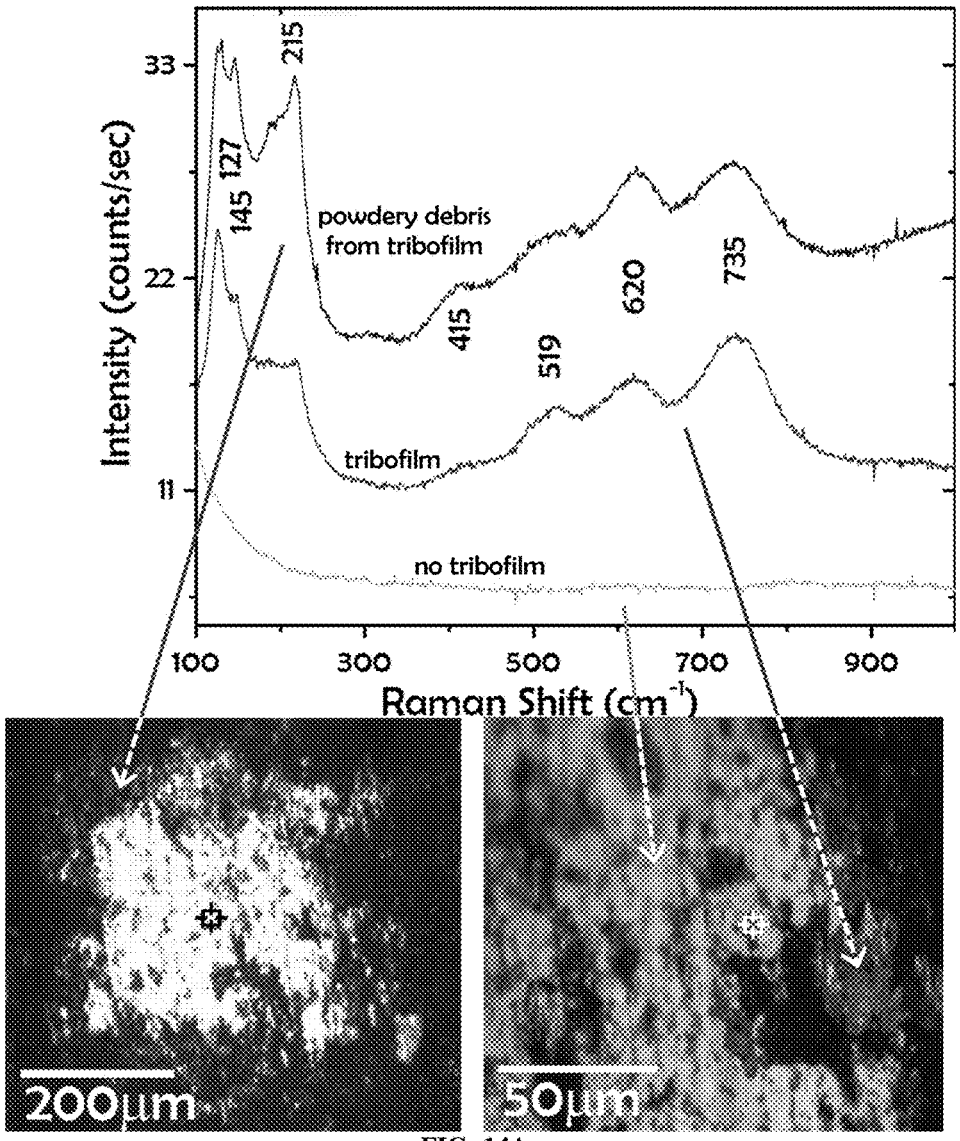
FIG. 14A-14B shows Raman analysis of different regions of a $Ti_3SiC_2$/Cu alloy cross-cylinder contact. Provided are (A) a Raman spectrum (top) and associated regions for the $Ti_3SiC_2$ top cylinder, including a region containing powdery debris from a tribofilm (bottom, left), a region with no tribofilm (bottom, center), and a region with tribofilm (bottom, right); and (B) a Raman spectrum (top) and associated regions for the Cu alloy bottom cylinder, including a region containing powdery debris from a tribofilm (bottom, left) and a region with tribofilm (bottom, right).
Figure 14B:
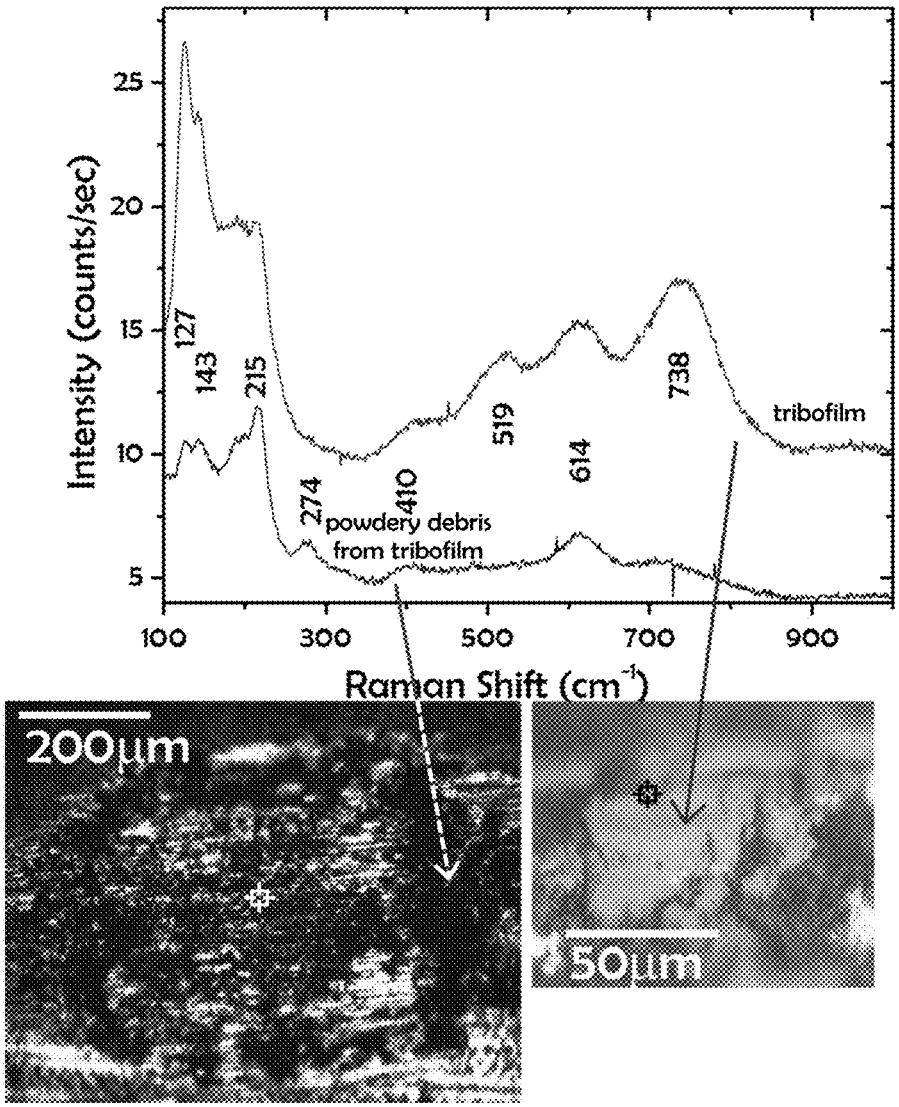

Raman analysis of MAX/Cu cross-cylinder contacts provided some insight into the beneficial friction coefficient and ECR parameters. Without wishing to be limited by mechanism, the formation of a stable tribofilm provides low friction coefficient and ECR values that are stable. Tribofilm formation depends, in part, on the composition of the first and second contacts. For instance, Raman analysis of the $Ti_3SiC_2$/Cu contact suggested tribofilm formation, where the tribofilm was then transferred to the Cu cylinder (compare Raman spectra for $Ti_3SiC_2$ in FIG. 14A and for Cu in FIG. 14B, where the second curve in FIG. 14B is similar to the top curve in FIG. 14B, suggesting tribofilm transfer).

However, the tribofilm for the $Ti_3SiC_2$/Cu contact only occupied a small area fraction of the contact surfaces and, instead, most of the tribofilm was ejected from the contact surfaces in the form of a loose powdery debris. In addition, the Raman spectrum for $Ti_3SiC_2$ displayed some different tribochemical peaks compared to self-mated $Ti_3SiC_2$, i.e., new peaks at about 519, 215, and 127 $cm^{-1}$ (top curve in FIG. 14A). These new peaks are likely from $Cu_2O$ (transferred from Cu cylinder), but these peaks were measured only in a small area fraction of the sliding contact surface, which supports the lack of a stable tribofilm at the contact surface between the first and second contacts.

Figure 15A:
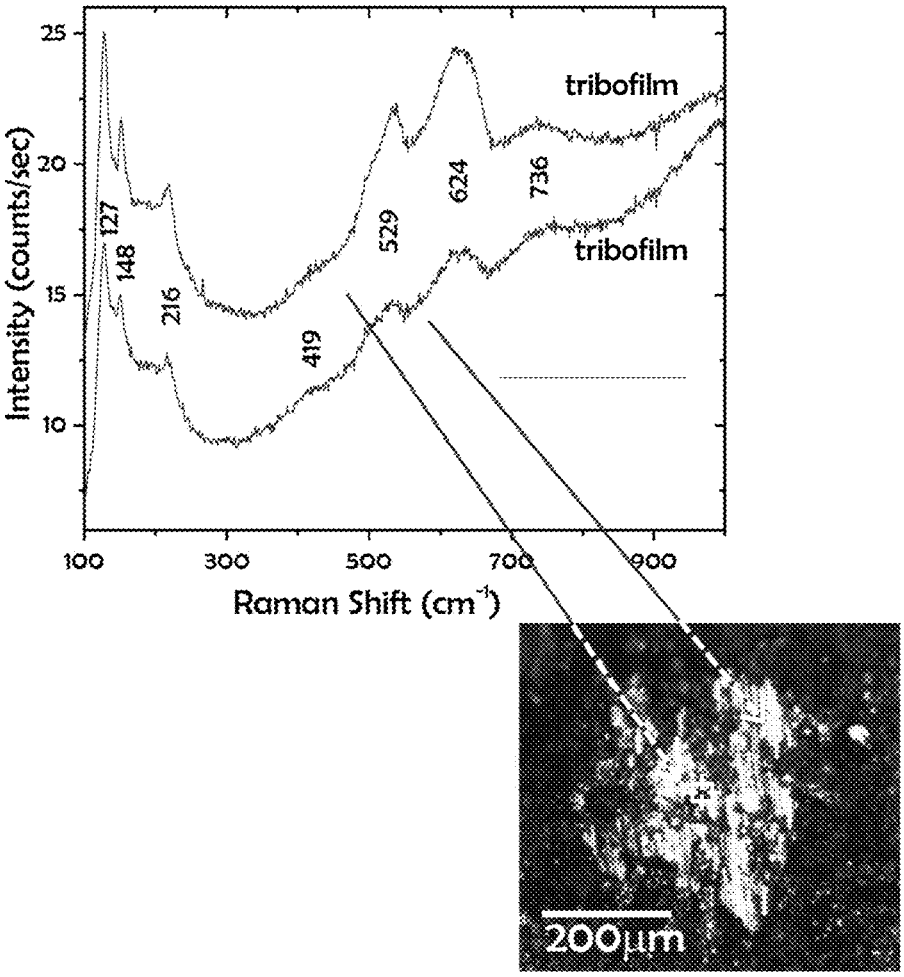
FIG. 15A-15B shows Raman analysis of different regions of a $Ti_2AlC$/Cu alloy cross-cylinder contact. Provided are (A) a Raman spectrum (top) and associated regions for the $Ti_3SiC_2$ top cylinder with tribofilm (bottom); and (B) a Raman spectrum (top) and associated regions for the Cu alloy bottom cylinder with tribofilm (bottom).
Figure 15B:
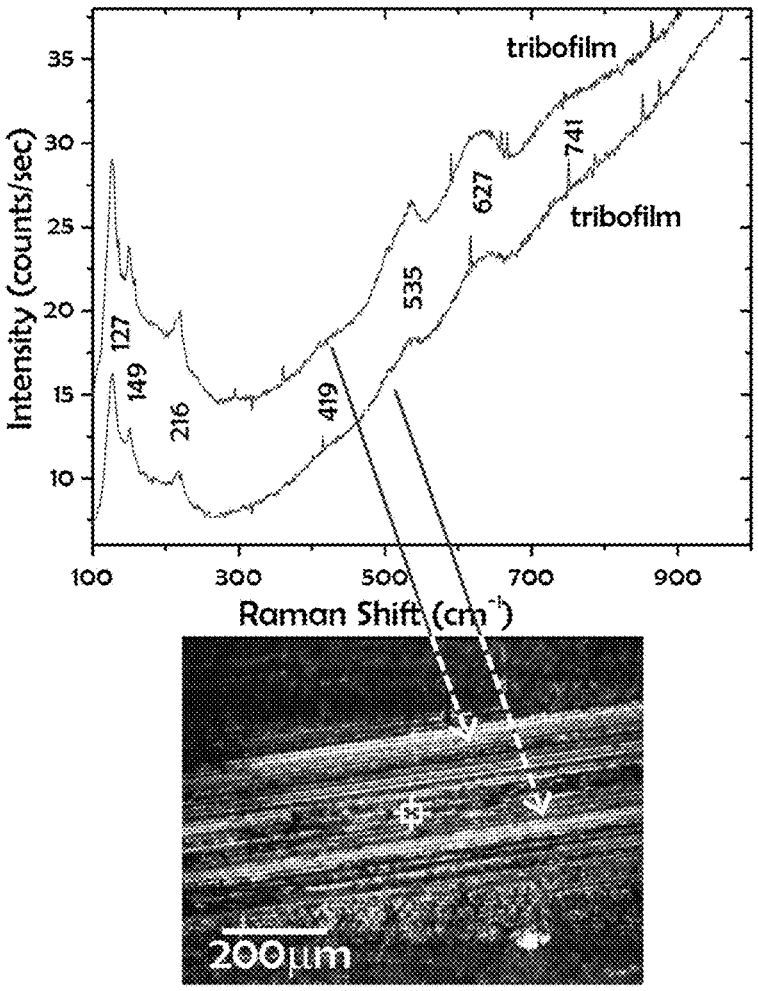

Raman analysis of the $Ti_2AlC$/Cu contact suggested the formation of a more stable tribofilm at the contact surface located between the $Ti_2AlC$ and Cu contacts. For instance, there was a much larger area fraction of stable tribofilm in the contact surface on both $Ti_2AlC$ and Cu cylinders, as well as much less ejected loose, powdery debris (FIG. 15A-15B). In addition, the Raman spectra displayed some different tribochemical peaks, as compared to self-mated $Ti_2AlC$, i.e., new peaks at about 529, 216, and 127 $cm^{-1}$, likely from $Cu_2O$ (FIG. 15A).

Overall, in the case of $Ti_2AlC$, low friction coefficients in the range of 0.15-0.25 were exhibited out to 10,000 sliding cycles in self-mated and against Cu alloys while maintaining low ECR values of ~20 mΩ. The wear removal was negligible, which is in contrast to much higher wear that graphite would exhibit against the Cu alloy. While $Ti_3SiC_2$ also exhibited similar behavior in self-mated sliding, the ECR values were higher at ~1.0 when sliding against the Cu alloy. Based on these analyses, it is clear that sintered bulk MAX phase materials may present a significantly more robust contact material in a number of engineering applications.

OTHER EMBODIMENTS

All publications, patents, and patent applications mentioned in this specification are incorporated herein by reference to the same extent as if each independent publication or patent application was specifically and individually indicated to be incorporated by reference.

While the invention has been described in connection with specific embodiments thereof, it will be understood that it is capable of further modifications and this application is intended to cover any variations, uses, or adaptations of the invention following, in general, the principles of the invention and including such departures from the present disclosure that come within known or customary practice within the art to which the invention pertains and may be applied to the essential features hereinbefore set forth, and follows in the scope of the claims.

Other embodiments are within the claims.

The invention claimed is:

1. An electrical contact assembly comprising:

a first contact comprising copper or a copper alloy;

a second contact configured for conductive engagement with the first contact, wherein the second contact comprises a monolithic structure comprising an $M_{n+1}AX_n$ compound, wherein M is an element of Ti, n is of from about 1 to about 3, A is an element of Al or Si, and X is the element of C or N; and a tribofilm disposed between the first contact and the second contact, wherein the tribofilm comprises copper oxide and the tribofilm arises from a sliding engagement between the first contact and the second contact.

2. The assembly of claim 1, wherein the $M_{n+1}AX_n$ compound comprises $M_{n+1}AlC_n$.

3. The assembly of claim 1, wherein the $M_{n+1}AX_n$ compound comprises $Ti_3SiC_2$.

4. The assembly of claim 1, wherein the $M_{n+1}AX_n$ compound comprises $Ti_{n+1}AC_n$ or $Ti_{n+1}AN_n$.

5. The assembly of claim 1, wherein the $M_{n+1}AX_n$ compound comprises $Ti_2AlC$.

6. The assembly of claim 1, wherein the monolithic structure comprises a spark plasma sintered laminate alloy.

7. The assembly of claim 1, wherein the first contact comprises a laminate alloy; and wherein the laminate alloy comprises an $M_{n+1}AX_n$ compound, M is a transition metal, n is of from about 1 to about 3, A is an element selected from Groups 12-16 in the IUPAC periodic table of elements, and X is the element of C or N.

8. The assembly of claim 7, wherein the laminate alloy of the first contact comprises a coating or a monolithic structure.

9. The assembly of claim 1, wherein the second contact comprises a contact surface configured to slide along a conductive surface of the first contact.

10. The assembly of claim 1, further comprising a plurality of second contacts, wherein at least one of the second contacts is configured for conductive engagement with the first contact, or a portion thereof, and wherein at least one of the second contacts comprises a monolithic structure comprising the $M_{n+1}AX_n$ compound.

11. The assembly of claim 1, wherein the first contact comprises a commutator and/or a slip ring.

12. The assembly of claim 1, wherein the second contact comprises a plurality of bristles, and wherein at least one bristle comprises the monolithic structure comprising the $M_{n+1}AX_n$ compound.

13. An electrical component comprising an electrical contact assembly of claim 1, wherein the first contact is stationary within a housing of the component and the second contact is configured for movement against a conductive surface of the first contact.

14. The component of claim 13, wherein the component is a motor, a generator, a railgun, a turbine, or a satellite.

15. The assembly of claim 1, wherein the tribofilm comprises an oxide of the conductive metal or metal alloy of the first contact.

16. The assembly of claim 1, wherein the first contact comprises copper or an alloy thereof, wherein the second contact comprises $Ti_2AlC$, and wherein the tribofilm comprises copper oxide.

17. A sliding electrical contact comprising:

a monolithic structure composed of an $M_{n+1}AX_n$ compound, M is an element of Ti, n is of from about 1 to about 3, A is an element of Al or Si, and X is the element of C or N;

a tribofilm disposed on a contact surface of the monolithic structure, wherein the tribofilm comprises copper oxide; and a contact comprising copper or a copper alloy.

18. The electrical contact of claim 17, wherein the friction coefficient is about 0.4 or less; the electrical contact resistance is about 0.1Ω or less; and/or wherein the electrical resistivity is about 25 μΩ·cm or less.

19. An electrical contact assembly comprising:

a first contact comprising copper or a copper alloy; and a second contact of claim 17, wherein the second contact is configured for conductive engagement with the first contact.

20. The assembly of claim 19, wherein the second contact is further configured for sliding engagement with the first contact.

* * * * *